US006318224B1

(12) United States Patent
Hoyland

(10) Patent No.: US 6,318,224 B1
(45) Date of Patent: Nov. 20, 2001

(54) SLICING OF PRODUCTS

(75) Inventor: Trevor Barry Hoyland, Taverham (GB)

(73) Assignee: Thurne Engineering Company Limited, Norwich (GB)

( * ) Notice: Subject to any disclaimer, the term of this patent is extended or adjusted under 35 U.S.C. 154(b) by 0 days.

(21) Appl. No.: 09/194,797

(22) PCT Filed: May 23, 1997

(86) PCT No.: PCT/GB97/01408

§ 371 Date: Dec. 1, 1998

§ 102(e) Date: Dec. 1, 1998

(87) PCT Pub. No.: WO97/46355

PCT Pub. Date: Dec. 11, 1997

(30) Foreign Application Priority Data

Jun. 1, 1996 (GB) ..... 9611465

(51) Int. Cl.[7] ..... B26D 7/06

(52) U.S. Cl. ..... 83/23; 83/29; 83/155.1; 83/90; 83/932

(58) Field of Search ..... 83/92, 77, 92.1, 83/29, 174, 932, 90, 155.1, 155, 157, 23

(56) References Cited

U.S. PATENT DOCUMENTS 514,237 * 2/1894 Moonelis ..... 83/29
2,012,489 * 8/1935 Walter ..... 83/92
2,528,888 * 11/1950 Klingens ..... 83/92
3,267,782 * 8/1966 Benzing ..... 83/92
3,831,472 * 8/1974 Sasaki ..... 83/92
3,933,066 * 1/1976 Spooner et al. ..... 83/92
4,077,287 * 3/1978 Makeev et al. ..... 83/92
4,079,645 * 3/1978 Nunez et al. ..... 83/92
4,405,186 * 9/1983 Sandberg et al. ..... 83/92
4,673,382 * 6/1987 Buk et al. ..... 83/92
4,730,762 * 3/1988 Felix ..... 83/92
5,649,463 * 7/1997 Lindee et al. ..... 83/174

FOREIGN PATENT DOCUMENTS

3612996A * 10/1987 (DE) ..... 83/29
0713753A2 * 5/1996 (EP) .
0262942 * 10/1990 (JP) ..... 83/92

* cited by examiner

*Primary Examiner*—Rinaldi I. Rada
*Assistant Examiner*—Omar Flores Sánchez
(74) *Attorney, Agent, or Firm*—Renner, Kenner, Greive, Bobak, Taylor & Weber

(57) ABSTRACT

A method of and apparatus for slicing products, such as of foodstuffs, has a slicing station at which slices are cut from a product fed to the station. The cut slices fall on a receiver arranged below the slicing station, and the vertical distance between the slicing station and the receiver is varied as a stack of slices builds up on the receiver.

15 Claims, 3 Drawing Sheets

SLICING OF PRODUCTS

This invention relates to methods of slicing products and also to slicing apparatus. The invention is particularly, but not exclusively, concerned with the slicing of foodstuffs such as meat, meat products, fish, fish products, cheese, bread and the like.

Automatic food slicers are well known and are able to perform rapid slicing of various food products, to produce individual batches of slices each containing a pre-selected number of slices and each batch being substantially of a pre-determined weight. Such slicers may be arranged to output each batch of slices as a stack, a so-called shingle or "fluffed". In the case of a stack, it is preferred for the edges of the slices to be aligned as closely as the product allows. A shingle comprises an array of slices where one edge of each slice is spaced by a pre-determined distance from the corresponding edge of the next slice. In a fluffed batch, the slices are relatively thinly sliced and arranged three-dimensionally in a random manner; this is typically used for insertion into sandwiches where randomly folded slices improve productivity and visual appeal.

In order to optimise the appeal to the end purchaser of a packaged stack or shingle of slices, it is preferred that the stack or shingle has the slices thereof arranged as neatly and uniformly as possible. This may be achieved by providing a conveyor to receive slices cut from the product, the conveyor being driven in a controlled manner dependent upon the cutting of slices from the product. When producing stacks of slices, the conveyor may be driven backwards towards the cutter as the slices fall on to the stack, to compensate for the reducing trajectory through which the slices fall as the stack builds up. In this way, a closely aligned stack of slices may be achieved. Conversely, when a shingle is to be produced, the conveyor may be driven away from the cutter so that successive slices fall in a partially overlapping manner on previously-cut slices.

It has been found that as stack heights increase, it is more difficult to produce a well-aligned stack by using reverse operation of the conveyor. Moreover, with high cutting rates, a completed stack of the required number of slices must be moved away very rapidly in order to allow the accumulation of slices for the next stack, before the next slice has been cut from the product. At the completion of each stack, the reverse action of the conveyor must be stopped and the conveyor accelerated quickly in the forward direction; in turn this can lead to distortion of the stack.

EP-A-0713753 discloses a complex apparatus for slicing products. This specification includes an arrangement for lifting the conveyor on which slices fall, but requires a slow cycle time, to discharge the cut slices after the required number have been cut, as the conveyor must be lifted back to its initial position.

The present invention aims at addressing the above-described problem, in order to facilitate the production of stacks of slices cut from a product at a relatively high rate, whilst allowing the production of well-aligned stacks.

According to the present invention there is provided a method of slicing a product to produce a formed stack of slices, in which method:

- the product is fed to a slicing station;
- slices are cut one at a time from the product at the slicing station and are allowed to fall on to a receiver;
- the vertical distance between the slicing station and the receiver is varied as a stack of slices builds up thereon; and
- a discharge means having an input end and arranged to receive a stack of slices from the receiver has its input end maintained substantially in alignment with the receiver during the varying of the vertical distance of the receiver from the slicing station.

It will be appreciated that by the method of this invention, the vertical distance through which each slice falls, following the cutting thereof from the product, may be maintained substantially constant by appropriate adjustment of the receiver position. In this way, it may be expected that each slice will be added to the stack at substantially the same position, that is, with the same unchanging trajectory. Thus, a stack of slices should be well-aligned, vertically.

The adjustment of said vertical distance should be performed to optimise the stack formation. The height of a stack of slices should substantially correspond to the distance through which the product has been fed to produce those slices, and thus the receiver may be moved during slicing through a vertical distance corresponding to the feeding of the product being sliced. However, a stack of slices may have a slightly different height than the length of product cut to form that stack and thus the adjustment of the vertical receiver may need to be slightly greater than the feeding of the product; and discharge means having an input end disposed adjacent the out-feed end of the receiver, the input end of the discharge means and the out-feed end of the receiver being linked to remain in vertical alignment during adjustment of the position of the receiver. A single control means may be provided for both the feeding of the product and the adjustment of the receiver and to control the latter dependent upon the former.

According to a second aspect of this invention, there is provided slicing apparatus comprising:

- feed means to feed to a slicing station in a controlled manner a product to be sliced;
- a slicing blade arranged at the slicing station to cut successive slices from product fed to the slicing station;
- a receiver for cut slices arranged below the slicing station and capable of vertical movement relative to the slicing station;
- adjustment means to adjust the vertical position of the receiver below the slicing station during slicing of the product; and
- discharge means having an input end disposed adjacent the out-feed end of the receiver, the input end of the discharge means and the out-feed end of the receiver being linked to remain in vertical alignment during adjustment of the position of the receiver.

In a preferred embodiment, the receiver is carried on a sub-frame, and the sub-frame is slidably mounted on a fixed part of the slicing apparatus for generally vertical movement. A servo-motor may be arranged for this purpose, for example by driving a lead screw having a nut coupled to the sub-frame or by driving an endless belt having a run coupled to the sub-frame.

In order to allow a stack of slices to be removed rapidly once the required number of slices has been cut from the product, it is preferred for the receiver to comprise the upper run of a first endless conveyor. A second endless conveyor may be arranged with the in-feed end thereof adjacent the out-feed end of the first conveyor, the first and second conveyors being provided with independent drive means to permit the independent operation thereof. By having a relatively short first conveyor, a stack may rapidly be transferred from the first conveyor to the second conveyor in order to allow the building up of a new stack on the first conveyor, whilst a completed stack is taken away for further processing such as weighing, packaging and if appropriate labelling.

Other features of the slicing apparatus of this invention may essentially be conventional and will be understood by those skilled in the art. Such features will not therefore be described in further detail here.

By way of example only, one specific embodiment of the present invention will now be described in detail, reference being made to the accompanying drawings in which.

Figure 1:
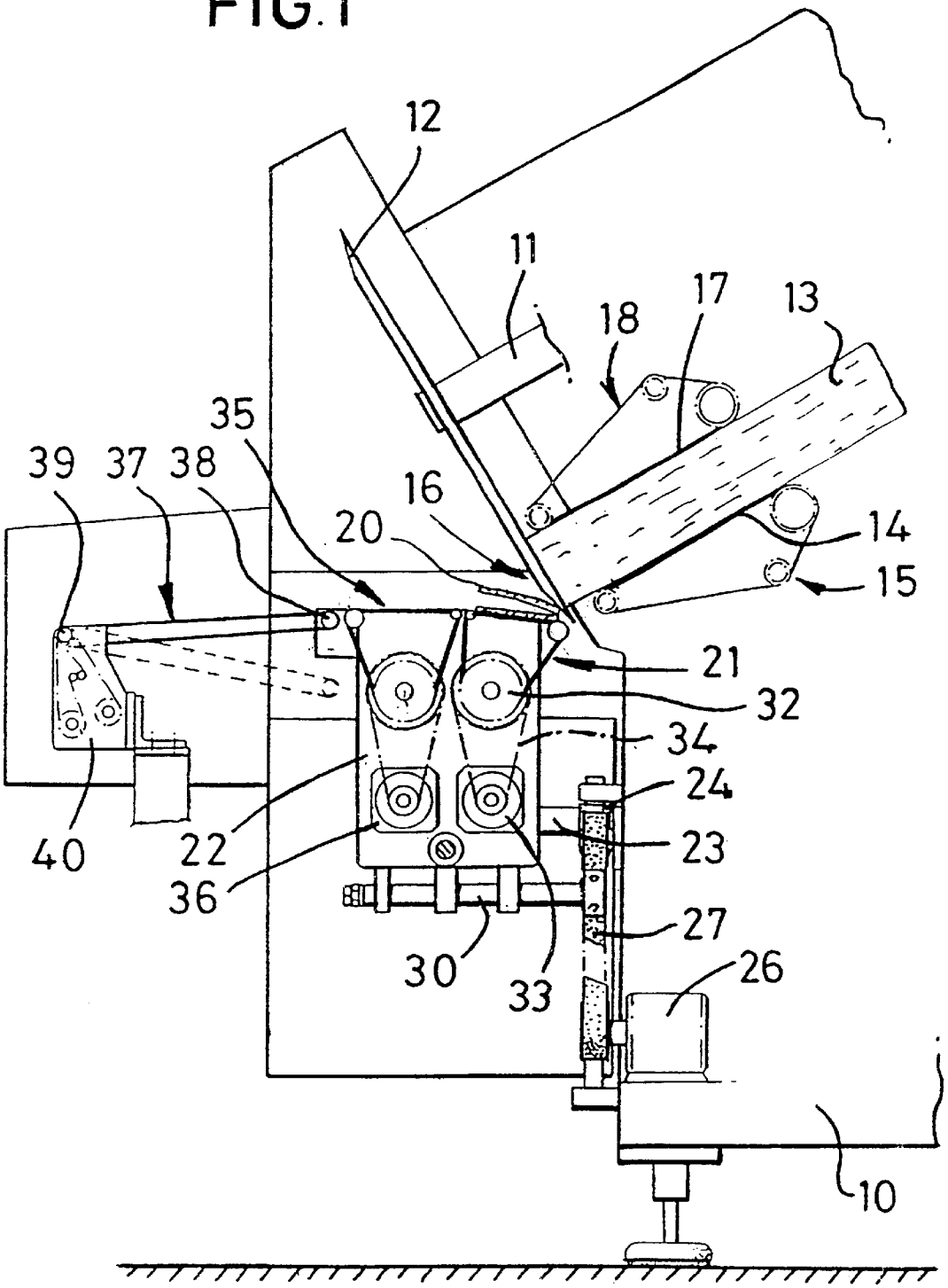
FIG. 1 is a diagrammatic partial side view of a slicing machine showing those parts constructed and arranged in accordance with the invention.
Figure 2:
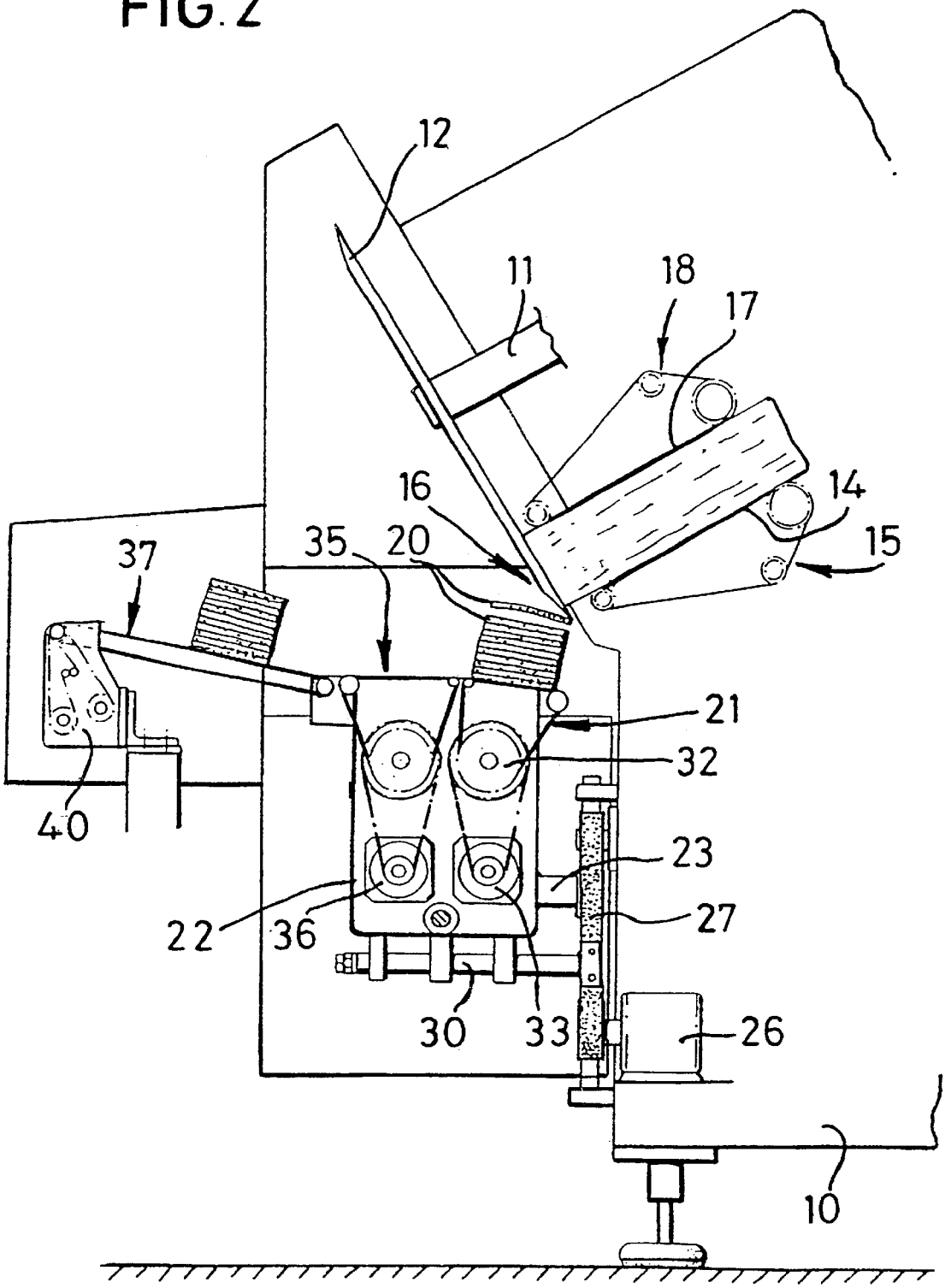
FIG. 2 is a view similar to that of FIG. 1 but showing certain parts in a second position.

The part of a slicing machine shown in the drawings comprises a main frame 10 on which is carried a shaft 11 supporting a rotary slicing blade 12 having a spiral cutting edge. Product 13 to be sliced, such as a so-called log of processed meat, is supported on the upper run 14 of a feed conveyor 15 so as to be fed to a slicing station 16 with blade 12, as shown. To ensure the product 13 is advanced by the required amount to produce a slice of a pre-determined thickness, the product is gripped between said upper run 14 and the lower run 17 of a top conveyor 18. The conveyors 15 and 18 are driven in unison at the appropriate rate for the slicing operation being performed.

Slices 20 cut from the product 13 fall on to the upper run of a first conveyor 21 carried on a sub-frame 22 disposed below the cutting station 16. A pair of arms 23 project from the sub-frame 22 towards the main frame 10 and each carries a slider 24 arranged to run on a respective column 25 provided on the frame 10. A servo-motor 26 drives an endless toothed belt 27 running around a pair of pulleys 28 and 29 arranged between the columns 25. A link 30 is clamped to the belt 27 and is coupled to the sub-frame 22. Operation of the servo-motor 26 will thus cause the sub-frame 22 to rise or fall vertically, below the cutting station 16.

The first conveyor 21 passes round a drive pulley 32, a servo-motor 33 being connected by a toothed belt 34 to the drive pulley 32. The upper run of the first conveyor 21 has a length slightly greater than that of the largest slices which the machine is to cut.

A second conveyor 35 is arranged on the sub-frame 22 with the in-feed end thereof closely adjacent the out-feed end of the first conveyor. A second servo-motor 36 is arranged to drive the second conveyor 35 in a substantially similar manner as the drive arrangement for the first conveyor 21. A third conveyor 37 passes around an idler roller 38 provided on the sub-frame 22 and has its in-feed end closely adjacent the out-feed end of the second conveyor 35. The out-feed end of the third conveyor passes around a roller 39 provided oh a fixed part, such as of a weighing machine. The third conveyor is furnished with an independent drive arrangement 40, including a respective servo-motor (not shown).

Figure 3:
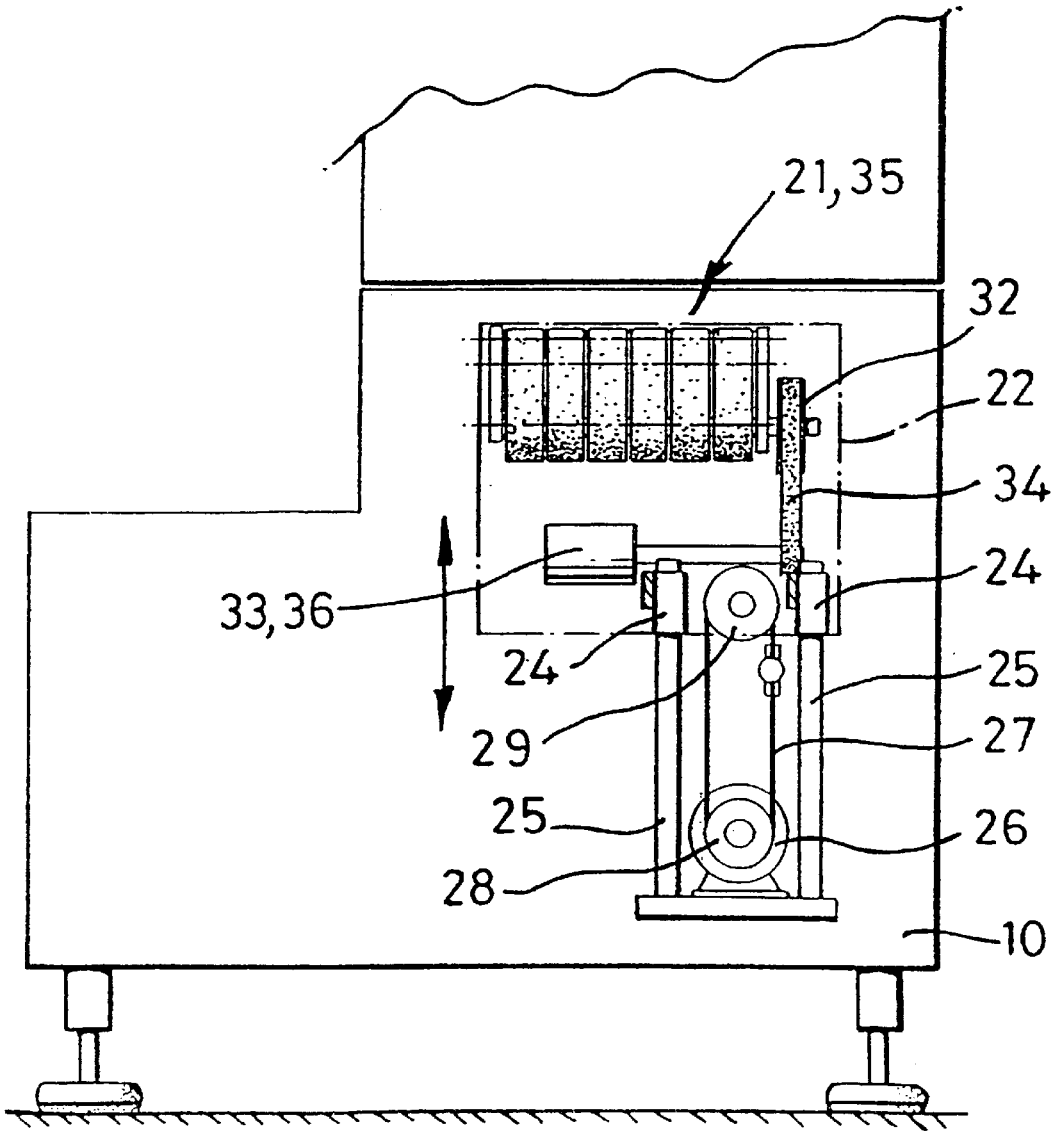
FIG. 3 is a diagrammatic end view showing certain parts of the machine of FIG. 1, with other parts cut away for clarity.

Each of the conveyors 21, 35 and 37 may comprise a plurality of relatively narrow belts arranged side-by-side, as shown in FIG. 3. Though only one lane is shown in the drawings, the slicing machine may have a pair of parallel lanes for cutting slices from two logs fed side-by-side to the cutting station. In this case, the third conveyor 37 may be divided laterally into two separately drivable conveyor parts whereby pairs of stacks of slices received on the third conveyor essentially simultaneously from the two lanes may be separated for delivery in a serial manner from the third conveyor.

The slicing machine includes a computerised control system (not shown) to control rotation of the blade 12, the driving of the conveyors 15 and 18, the operation of the servo-motor 26 to raise and lower the sub-frame 22, the first and second conveyors 21 and 35, and also of the third conveyor 37, or the third conveyor parts, in order to achieve the required slicing performance.

In operation, a log 13 is fed at an appropriate rate by the conveyors 15 and 18 to the slicing station 16 in order that the blade 12 will cut therefrom slices 20 each having the required thickness. The feeding of the product may be adjusted dynamically during slicing, in order to cut slices having an appropriate weight and thus to ensure a stack of the required number of slices also has a desired weight.

At the commencement of a slicing operation, as shown in FIG. 1, the sub-frame 22 is raised to its uppermost position with the upper run of the first conveyor 21 closely adjacent the slicing station. As a stack of slices is built up on the conveyor 21, the sub-frame 22 is lowered by appropriate operation of the servo-motor 26. The rate of descent of the sub-frame 22 should be substantially the same as the rate of feeding of the product to be sliced, in order to ensure that each slice falls through substantially the same distance, irrespective of the position in a stack of that slice.

Once the required number of slices has been accumulated in a stack, the first and second conveyors 21 and 35 are rapidly driven at substantially the same speed, to transfer a stack on to the second conveyor. At the same time, the sub-frame is returned to its initial position to allow the accumulation of a further stack of slices. The speed of the second conveyor is then matched to that of the third conveyor, to transfer the stack to the third conveyor, from whence the stack may be further processed, for example by weighing, wrapping and (if required) labelling.

In the event that some fine adjustment of the vertical alignment of a stack is required, the first conveyor 21 may be driven in an appropriate direction to achieve a stack of the required form, simultaneous with the vertical movement of the sub-frame 22. Should a shingle of slices be required, the sub-frame may be set at an appropriate distance below the slicing station 16 and then the conveyors 21 and 35 driven during the slicing operation, to arrange the slices in the desired array. The machine may also be set to produce "fluffed" very thin slices of an appropriate product, by setting the sub-frame 22 at an appropriate position and driving the first and second conveyors at suitable speeds to ensure random folding of the slices.

What is claimed is:

1. Slicing apparatus comprising:

feed means to feed a slicing station in a conventional manner a product to be sliced;

a slicing blade arranged at the slicing station to cut successive slices from product fed to the slicing station;

a sub-frame slidably mounted on a fixed part of the slicing apparatus for generally vertical movement;

a receiver for cut slices and arranged below the slicing station, said receiver having an outfeed end and being carried on the sub-frame for vertical movement with the sub-frame relative to the slicing station, the receiver further including first and second endless conveyors mounted on the sub-frame and arranged in a fixed angular orientation with respect to each other such that an infeed end of the second conveyor is located substantially adjacent an outfeed end of the first conveyor and such that the first and second conveyors are maintained in fixed relationship to each other during any variation of vertical position between the slicing station and the receiver;

adjustment means to adjust the vertical position of the sub-frame and so also of the receiver below the slicing station during slicing of the product; and discharge means having an input end disposed on the sub-frame adjacent the outfeed end of the receiver, the input end of the discharge means and the outfeed of the receiver being linked by the sub frame to remain in vertical alignment during adjustment of the vertical position of the sub-frame.

2. Slicing apparatus as claimed in claim 1, wherein there is control means arranged to control operation of both the feed means and the adjustment means.

3. Slicing apparatus as claimed in claim 2, wherein the adjustment means is controlled by the control means to move the receiver downwardly away from the slicing station at substantially the same rate as the feed means advances product to be sliced to the slicing station.

4. Slicing apparatus as claimed in claim 1, the receiver comprises the upper run of at least one endless conveyor.

5. Slicing apparatus as claimed in claim 1, wherein the first and second conveyors are provided with independent drive means whereby the two conveyors may be operated independently of one another.

6. Slicing apparatus as claimed in claim 1, wherein the discharge means comprise the upper run of a conveyor which is controlled during use to remove the stacks of slices that are fed thereon from the out-feed end of the receiver.

7. Slicing apparatus as claimed in claim 1, wherein the adjustment means for the sub-frame comprises a servo-motor drivingly coupled to the sub-frame.

8. Slicing apparatus as claimed in claim 7, wherein the servo motor drives an endless belt arranged in a generally vertical plane and running around a pair of generally vertically spaced pulleys, and the sub-frame is linked to one run of the belt extending between the two pulleys.

9. A method of slicing a product to produce a formed stack of slices, using a slicing machine having a slicing station, a receiver for slices cut from the product at the slicing station which receiver comprises first and second endless conveyors arranged in a fixed angular orientation end to end with respect to each other, and a discharge means for a stack of slices built up on the receiver, which discharge means includes an input end for receiving the stack of slices from the receiver, the method comprising:

feeding the product to a slicing station;

cutting slices one at a time from the product at the slicing station and allowing the slices to fall on to said first endless conveyor of the receiver to build up a stack of slices thereon;

varying the vertical distance between the slicing station and the receiver as the stack of slices builds up on the receiver, the first and second conveyors remaining in fixed relationship with respect to each other during variation of the vertical distance;

maintaining the input end of the discharge means substantially in alignment with said second endless conveyor of the receiver during the varying of the vertical distance of the receiver from the slicing station; and following the formation of a stack of slices on the first endless conveyor, transferring the stack from that conveyor to the second endless conveyor, from where the stack of cut slices is moved to the discharge means.

10. A method as claimed in claim 9, wherein said vertical distance is increased as the stack of slices builds up on the receiver.

11. A method as claimed in claim 10, wherein said vertical distance is adjusted as the stack builds up so that the vertical distance through which each slice falls remains substantially constant.

12. A method as claimed in claim 11, wherein the increase in the vertical distance corresponds to the feeding of the product being sliced, to the slicing station.

13. A method as claimed in claim 11, in which there is provided control means for controlling the operation of feed means for feeding the product to the slicing station and adjustment means for adjusting the vertical position of the receiver, wherein said control means simultaneously provides corresponding control signals to the feed means and the adjustment means to affect corresponding operation thereof.

14. A method as claimed in claim 9, wherein the operation of said first endless conveyor is controlled during the cutting of slices to give the stack of slices building up on the conveyor a pre-determined profile.

15. A method as claimed in claim 14, wherein the first and second endless conveyors are operated rapidly to transfer a built up stack of slices from the first conveyor to the second conveyor and then to the discharge means following the cutting of a pre-determined number of slices, and simultaneously the upper run of the first conveyor is returned to its initial position below the cutting station to permit the building up of another stack of slices.

* * * * *